US006134778A

United States Patent [19]

Chandler

[11] Patent Number: 6,134,778

[45] Date of Patent: Oct. 24, 2000

[54] METHOD OF CONNECTING A WIRE TO AN ELECTRICAL DEVICE

[75] Inventor: David L. Chandler, Holmdel, N.J.

[73] Assignee: Tyco Submarine Systems Ltd., Morristown, N.J.

[21] Appl. No.: 09/116,104

[22] Filed: Jul. 15, 1998

[51] Int. Cl.[7] ..... H01R 43/02

[52] U.S. Cl. ..... 29/860; 29/857

[58] Field of Search ..... 29/825, 857, 858, 29/859, 860, 861, 862; 174/71 R, 19

[56] References Cited

U.S. PATENT DOCUMENTS

| | | | |
|---|---|---|---|
| 2,712,687 | 7/1955 | Uline | 29/857 |
| 3,962,530 | 6/1976 | Jones . | |
| 5,095,178 | 3/1992 | Hollingsworth . | |

*Primary Examiner*—Carl J. Arbes

[57] ABSTRACT

For connecting a high voltage wire to an elongated terminal of an electrical device, a connector link is provided comprising a first hollow tubing having an open first end with an extending flattened portion of the tubing bent to form the wall of a second hollow tubing having an axis of elongation perpendicular to the axis of elongation of the first tubing. The second hollow tubing is interference fitted onto the terminal and an end of the high voltage wire is inserted into the open end of the first tubing. The wire end is soldered to the first tubing and the second tubing is soldered to the terminal. An abundance of solder is used for causing the solder to flow outwardly from the ends of the tubings to form a continuous well-wetted shape of solder having smooth and rounded surfaces for avoiding concentrated electric fields and attendant electrical discharges.

12 Claims, 4 Drawing Sheets

SECTION A-A

METHOD OF CONNECTING A WIRE TO AN ELECTRICAL DEVICE

BACKGROUND OF THE INVENTION

This invention relates, in general, to electrical devices having externally extending terminals, and particularly to the interconnections between such terminals and high voltage connecting members.

A well recognized problem associated with connections made between high voltage carrying members is the possibility of electrical corona discharges and/or electrical arcing caused by sharp edges or points at the connections. As known, such edges or points cause electrical charge concentrations and attendant high electrical fields. In some instances, the practice is to encase the connection joint of a device terminal with a high voltage power line within a "corona shield", i.e., a relatively large member having only smooth surfaces and well rounded corners. Disadvantages of such corona shields are that they add expense and add to the device space requirements. Indeed, in some instances, the presence of the relatively large corona shields so reduces the free space between adjacent terminals at different voltages that the risk of voltage arcing increases.

By way of example, the present invention is described in connection with a known type of electrical relay used for switching an input high voltage power line between alternate output high voltage power lines. The term "high voltage" is relative and is actually a function of the electrical device involved. Thus, even a relatively small voltage , if applied to a pointed needle, can cause voltage arcing. In the illustrative example, voltages of around 10,000 volts d.c. are switched by the relay.

In one application, for example, the illustrative relay is used in the powering of undersea telecommunication cables. During the operation of these systems, it is sometimes desirable to be able to switch power connections remotely at an undersea station. This is accomplished using a high voltage relay.

The illustrative relay is of known type comprising (FIGS. 1, 1A, 1B) an hermetically sealed envelope 10 enclosing one or more sets of relay contacts. For reducing the possibility of electrical arcing between contacts during power switching, or at other times,the envelope is either evacuated or contains a gas strongly resistant to ionization. The various relay contacts are connected, within the envelope, to terminals 12 which pass outwardly through the envelope wall 10 in hermetically sealed relation therewith. An input power line 14 is typically connected to the terminal 12, and two, or more, output power lines are connected to other terminals of the relay.

In the illustrative relay, the terminals 12 comprise solid rods of tungsten, or a glass-sealable alloy, and, as detailed in FIGS. 1 and 1B, two techniques are typically used for connecting an end 16 of each power line 14 to a respective terminal. Both techniques involve soldering or brazing the wire ends to the terminals and both techniques involve first sliding and securing a hollow tubing connector link or sleeve 18 onto the device terminals (FIG. 1B). The two techniques differ in how the wire ends are initially mechanically secured to the tubings sleeves 18.

In one technique, as illustrated in FIG. 1B, the hollow tubing 18 mounted on the terminal 12 includes a radially extending plate or tab 20 having an opening 22 therethrough. An end 16 of the power line 14 is passed through the plate opening 22 and tightly looped (typically by hand held pliers) around the plate to secure the wire end in place. The looped wire end is then soldered to the plate, taking care that the solder joint completely encapsulates the end 16 of the wire as well as most of the plate 20 in a smooth layer of solder. Provided the resulting solder layer is properly shaped and fully encloses the connection between the wire end 16 and the apertured plate 20 (as well as completely enclosing the opening 22 therethrough), associated corona discharges and electrical arcing are generally avoided, at least for limited voltage levels.

Problems, however, are that the wire wrapping and soldering processes must be quite carefully performed and, aside from being time consuming and expensive, all too often are not properly done. Moreover, even when optimally performed, the resulting joint structure is highly variable and of inherently poor shape for avoiding high electric fields. Such connections are often not adequate for cases involving close proximity to an electrical ground point. Also, corona shields are not compatible with this type of terminal design.

In another technique, illustrated in FIG. 2, the hollow tubing 18 mounted on the terminal 12 extends axially beyond the end 24 of the terminal 12. The end 16 of the power line 14 is then inserted into the hollow tubing 18 through its open end 26 and soldered in place. The resulting soldered joint can be well controlled and with good quality, but the design suffers from another major disadvantage as clarified below.

The problem is that with the specified high voltage clearance required, the axial terminal extension of FIG. 2 is not feasible in the limited physical space of many equipment designs.

As shown in FIG. 2, the end 16 of the power line 14 must be axially aligned with the tubing 18 mounted on the terminal 12. This is simply not feasible in many cases because of lack of space. In the FIG. 1 technique, for example, the power lines 14 can be routed to approach the terminals in directions transverse to the terminals and positioned inwardly from the ends 24 of the terminals 12. This means that a housing (usually at electrical ground) enclosing the relay device, and the power lines extending to and from the relay device, can have an inner diameter not much greater than the relay device and its radially extending terminals. This is not as feasible with the FIG. 2 technique because, even if the power lines are bent into directions transverse to the device terminals, the wire ends 14 must project at least a short distance radially outwardly from the tube open ends 26, and high voltage clearances to electrical ground must also be provided.

Thus, while the FIG. 2 technique is generally preferred as a high voltage design over the technique of FIG. 1, for high voltage reliability, physical space problems often prevent use of the FIG. 2 technique. For cases of higher voltage and limited space, another technique is needed. The present invention avoids the problems associated with both existing techniques, while providing improvements over both.

SUMMARY OF THE INVENTION

A link for interconnecting an end of a wire to an elongated terminal of a device comprises a single continuous tubing having first and second portions. The first portion includes a hollow straight length having one open end adapted to receive a wire and having a second end attached to the second portion which constitutes a flattened length of the tubing forming the wall of a tubular member bent around a central axis transverse to the axis of the first portion of the tubing. In use, the tubular member is coaxially slid onto the device terminal with the first portion of the tubing extending transversely from the terminal. An end of a wire is inserted into the one end of the first portion of the tubing, and a brazing material or solder is applied for bonding the tubular member to the terminal and the wire end to the first portion of the tubing.

DESCRIPTION OF THE DRAWING

The drawings are somewhat schematic and not necessarily to scale.

DESCRIPTION OF PREFERRED EMBODIMENT OF THE INVENTION

As mentioned above, the present invention makes use of a connector link for interconnecting the end of a wire, e.g., of a power line, to a terminal of an electrical device, e.g., a power switching relay. A description of how the connector link is formed is first provided.

The starting workpiece (shown in FIGS. 3 and 4 after a first processing step shortly to be described) comprises a straight length of tubing 30 of a conductive material. Conveniently, for a reason hereinafter described, an inspection hole is provided through the tubing wall. A preferred material of the tubing is pure copper so treated (in known manner) to be "half hard", i.e., to be quite ductile while still retaining some spring temper. The tubing 30 can be made in a known extrusion process followed by a rate of cooling not so long as to completely anneal and soften the copper but not too quick as to provide it with a high degree of stiffness. The desired temper will become evident from how the tubing is further processed and later used.

Figure 3:
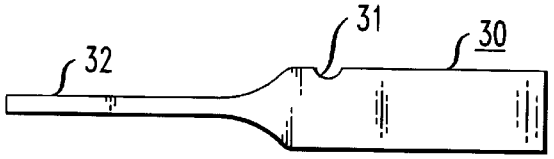
FIGS. 3 and 4 are, respectively, side and plan views of a tubing including open and collapsed length portions for use according to the invention.
Figure 4:
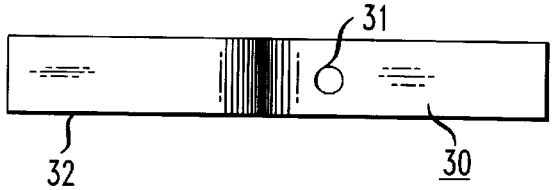

As illustrated in FIGS. 3 and 4, one end portion 32 of the tubing 30 is completely collapsed to a flat, strip-like configuration having a width slightly greater than the outer diameter of the tubing 30. Collapsing the tubing is done quite easily by hand with a pair of pliers or in a vise or fixture designed for the purpose. The stiffness of the copper tubing should not be too great so as to cause splitting open the sides of the tubing upon collapse, but stiff enough that the strip-like portion 32 of the tubing is fairly rigid for retaining its shape while possessing some spring-like elasticity.

Figure 5:
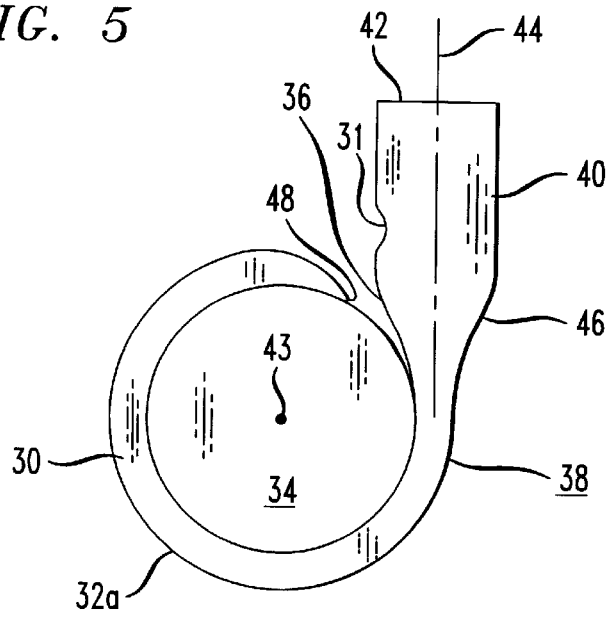
FIG. 5 is a side view similar to FIG. 3 but showing the collapsed portion of the tubing bent around a mandrel.
Figure 7:
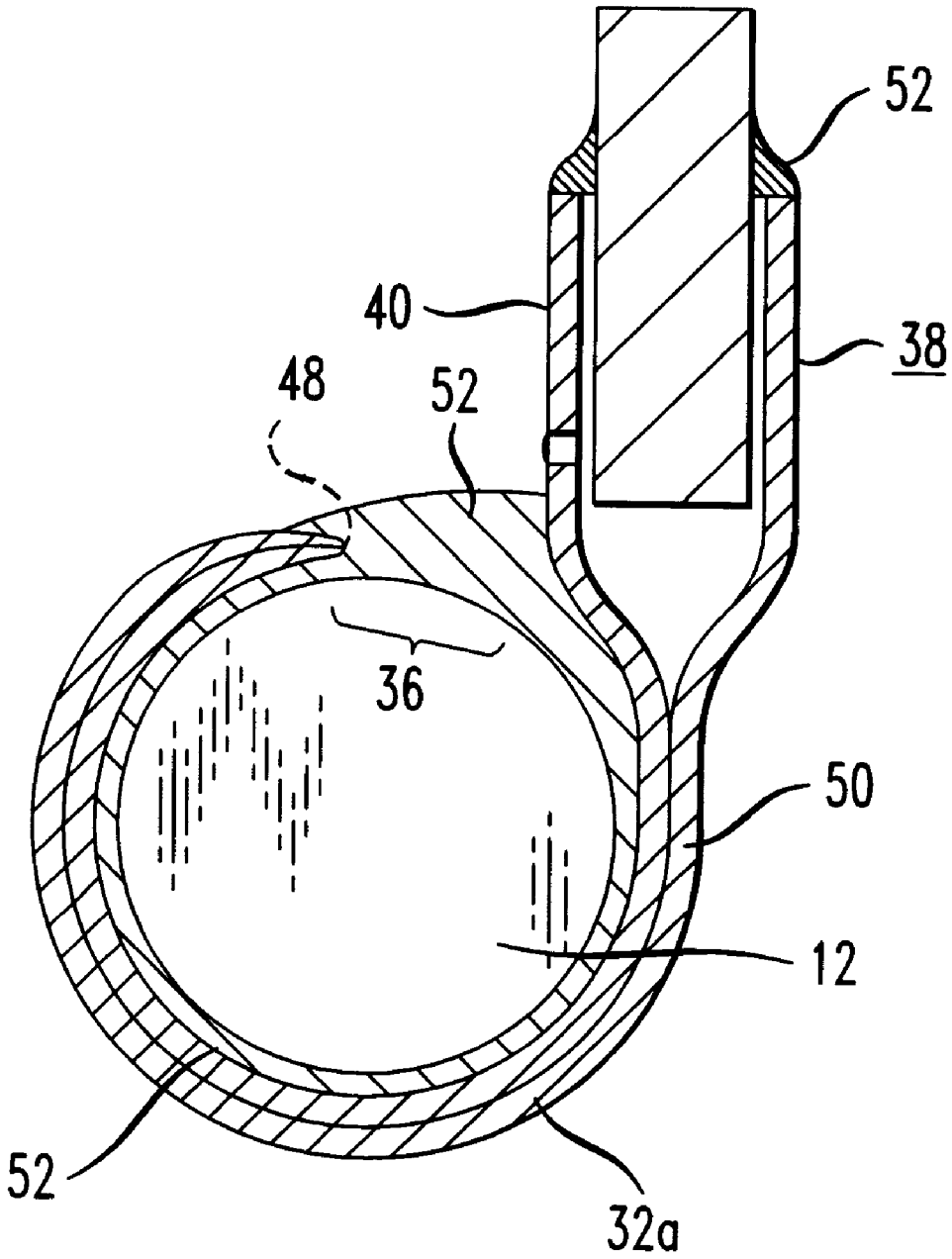
FIG. 7 is a section through the bonded link connector taken along line 7—7 of FIG. 6.

Next, as shown in FIG. 5 (also, see FIG. 7), the portion 32 of the tubing is bent around a circular mandrel 34 to shape the strip-like portion 32 into a C-shaped cylinder, that is, a circular hollow cylinder having an axially extending gap 36 through the cylinder wall. The axial length of the cylinder is equal to the width (FIG. 4) of the strip-like portion 32.

The shaped workpiece, now forming a connector link 38 ready for use, can be described as an integral continuous piece of tubing having first and second portions. The first portion comprising a first hollow tubing 40 having an open first end 42, and the second portion comprising an extending flattened portion of the tubing forming the wall of a second hollow tubing 32*a* having an axis 43 of elongation off-set from, and perpendicular to, the axis 44 of elongation of the first tubing 40. The cross-section of the first portion, tubing 40, is circular, while the cross-section of the second portion, tubing 32*a,* is C-shaped. The completely collapsed wall of the second portion, tubing 32*a,* is connected to the first portion, tubing 40, by an intermediate zone 46 along which the shape of the first tubing changes from circular to flat. The location of the intermediate zone 46 relative to the second tubing is not critical except that, preferably, the end 48 of the wall of the tubing 32*a* (at the axial gap 36 through the wall of the tubing 32*a*) is disposed close to but not against the wall of the intermediate zone 46. The tubing 32*a* has two open ends 50 (only one such end 50 being visible in FIG. 5; both ends 50 being visible in FIG. 7).

Figure 1:
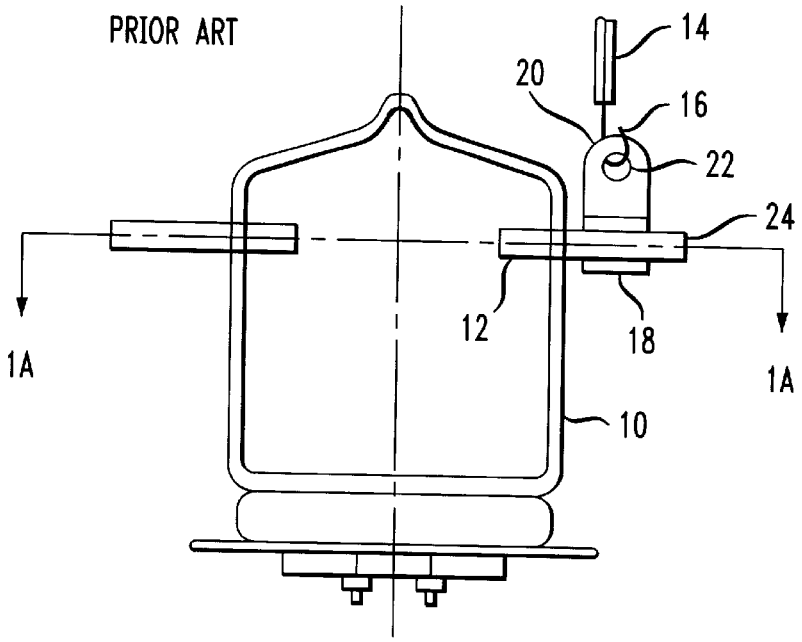
FIG. 1 PRIOR ART
FIG. 1 is a side view of a prior art relay.
Figure 1A:
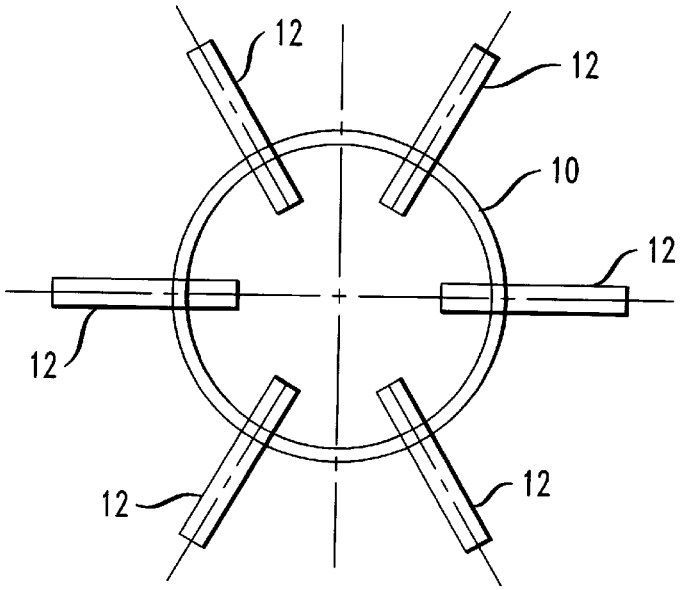
FIG. 1A is a sectional top view of the relay of FIG. 1 showing the terminals extending radially.
Figure 1B:
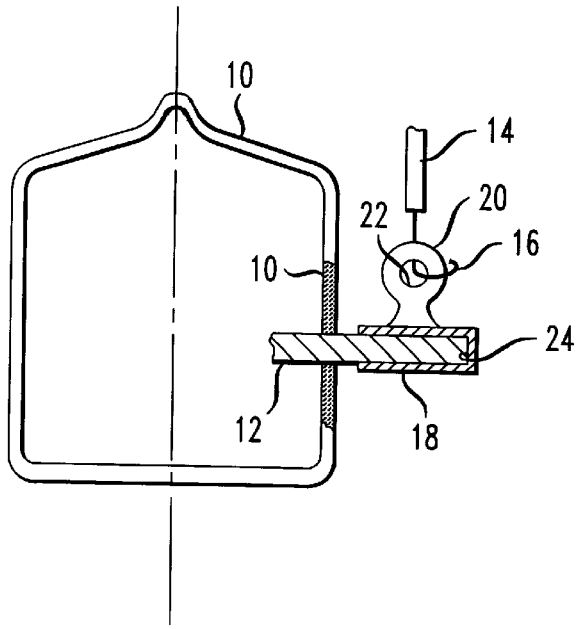
FIG. 1B PRIOR ART
FIGS. 1B and 2 are sectional views taken through a portion of the wall of a housing of an electrical device, each figure showing a portion of a device terminal extending, in hermetically sealed relation, through the housing wall and connected, using respective and known connecting techniques, to the end of a high voltage power wire.
Figure 2:
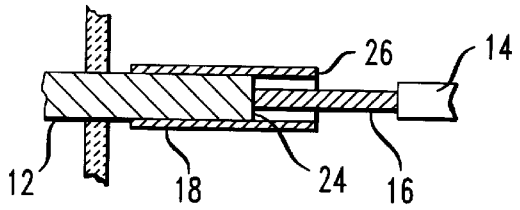
FIG. 2 PRIOR ART

The inner diameter of the first portion,tubing 40, is slightly larger than the outer diameter of a wire 14 (FIGS. 1 and 2) to be connected to a device terminal 12. The inner diameter of the second portion, tubing 32*a,* is equal to the diameter of the mandrel 34 (FIG. 5) about which the second tubing 32*a* is formed, which diameter is slightly less than the diameter of the device terminal 12.

Figure 6:
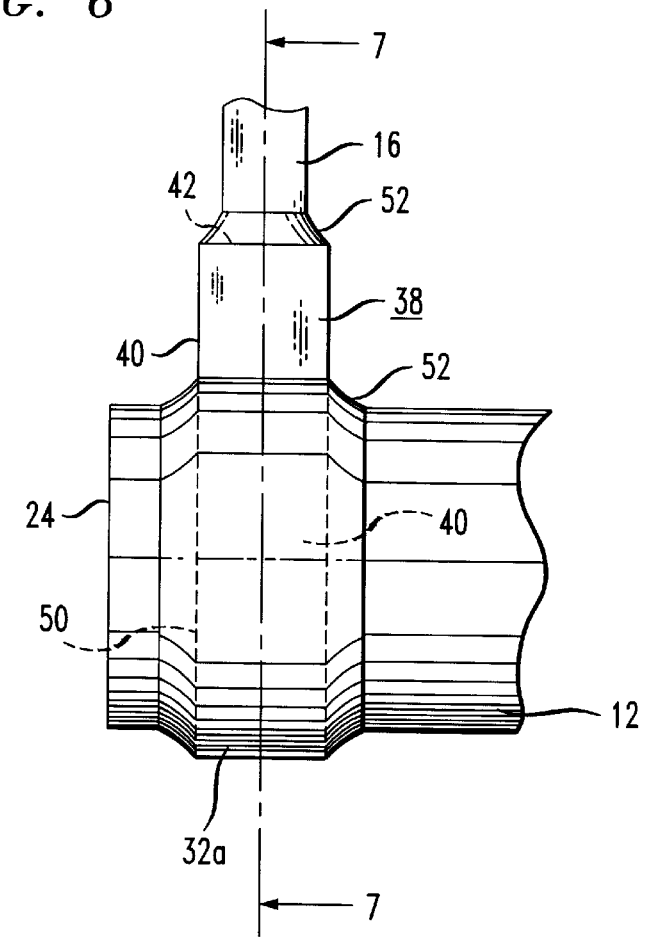
FIG. 6 is a side view of a connector link, in accordance with this invention, solder bonded to, and providing an interconnection between, a power line and a terminal of an electrical device.

Next, the now completed connector link 38 is (FIGS. 6 and 7) mounted on a device terminal 12 by sliding the C-shaped tubing 32*a* onto the terminal. As previously noted, the diameter of the C-shaped tubing 32*a* is slightly less than the diameter of the terminal 12 and the thus slightly expanded tubing 32*a* is resiliently clamped around the terminal. Sliding or the urging of the tubing 32*a* onto the terminal 12 may also be referred to as "interference fitting". For ease of hand mounting of the tubing 32*a* onto the terminal 12, the inner diameter of the tubing 32*a* is preferably as close as possible to the diameter of the terminal while still providing the desired spring clamped mounting. For example, with a terminal 12 having a nominal outer diameter of 0.120 inch, the nominal inner diameter of the tubing 32*a* is 0.100 inch. (approx.)

The positioning of the tubing 32*a* on the terminal 12 is critical only in that the tubing 32*a* is fully slid onto the terminal 12 with no portion of the tubing 32*a* extending beyond the outer end 24 of the terminal. The open end 50 of the tubing 32*a* at the end of the terminal 12 can be flush with the end of the terminal, but, most simply, the tubing 32*a* is slid onto the terminal 12 until a short length of the terminal protrudes outwardly from the tubing end 50. The reason for avoiding any overhang of the tubing 32*a* is described hereinafter.

With the second portion, tubing 32*a,* of the connector link mounted co-axially on the terminal 12, the first portion, tubing 40, of the connector thus extends (FIG. 6) transversely from the terminal 12. Any required angular orientation of the link tubing 40 relative to the terminal is obtained by rotating the connector link around the terminal 12. Once so angularly positioned, the link remains stationary in place owing to the spring clamping of the tubing 32*a* around the terminal 12.

The next step is to insert an end 16 of a wire 14 to be connected to the terminal 12 into the open end 42 of the tubing 40. Alignment of the wire end with the tubing is readily obtained by movement of the connector link along and about the terminal (while still avoiding any overhanging of the tubing 32*a* beyond the end 24 of the terminal).

With the wire end 16 firmly inserted within the tubing 40, the connector link is firmly secured to both the terminal 12 and the wire 14 by soldering or brazing. As previously described in connection with FIGS. 1 and 2, prior art practice is to slide a short tubing 18 onto a device terminal 12 and to solder or braze the tubing in place. To this end, the device terminals 12, of tungsten in the illustrative high voltage relay device, are typically provided with a plating of nickel, or tin for better wetting by a solder or brazing material. Typically, the terminals of other electrical devices with which the present invention can be used are of materials suitable for connections by soldering or brazing. (Note that bonding, fusing, or fusing bonding, as used herein, may include the use of filler or non-filler material.)

A conventional wire soldering process can thus be performed for securing the connector link 38 in place. Thus, an end of a solder wire is held against the workpiece while a soldering iron is placed against the workpiece to heat it and to melt the solder. By placing the solder wire end at the small gap 36 (FIG. 7) in the wall of the tubing 32*a,* the molten solder flows between the terminal outer surface and the inside surface of the tubing 32*a* for firmly and completely soldering the tubing to the terminal 12. Likewise, solder is flowed into the open end 42 of the tubing 40 for securely soldering the wire 14 within the tubing 40. The soldering process and the proper flow of the molten solder is entirely in accordance with conventional and widely used soldering practices.

Significantly, by using an adequate amount of solder, the solder flows outwardly from the solder joints so formed and provides a smooth and continuous solder surface completely encasing the outside surface of the tubing 32*a,* the gap 36 through the wall of the tubing wall 32*a,* and covering the full length of the C-section tubing. An indication of the full desired flow of the molten solder is provided by the solder, provided at the open end 42 of the tubing 40, reaching the inspection hole 31 (FIG. 3) provided through the tubing wall. While the solder may not flow onto the end face 24 of the terminal 12 (which, may or may not be plated) typically, the solder extends (FIG. 6) from the tubing 32*a* onto the terminal surface in a smooth, rounded joint 52 having no sharp edges. Should the tubing 32*a* of the connector link 38 extend beyond the edge of the terminal, there is a likelihood that, owing to the non-wettability of the end face of the terminal, the overhanging end of the tubing 32*a* will not be completely closed with a smooth layer of solder. Rather, the outer edge 50 of the tubing 32*a* might be exposed in the form of an undesirably sharp edge leading towards voltage discharges, a condition to be avoided.

In the absence of any exposed sharp edges, the smooth, rounded and continuous surface of the layer of solder on the outside surfaces of the terminal 12 and the tubings 32*a* and 40 serves as an excellent corona shield. Additionally, and in contrast to typical corona shields which are relatively large objects mounted to completely surround each terminal and its connecting wire, the solder layer encasing the wire connector link adds practically nothing to the dimensions of the wire-terminal interconnection. Thus, the spacings between the various components of the high voltage device needed for voltage insulation are fully preserved.

Another significant advantage of the connector links formed in accordance with the invention is that the wires are fused to the connector links within a short distance of the external wall of the relay and can run (be laid out) parallel to the length of the external wall of the relay. This enables a power relay and its associated power lines to be positioned within a relatively small tubular or cylindrical space. This also enables several power relays to be stacked within a small tubular space which in some applications is extremely advantageous.

What is claimed is:

1. A method of connecting a wire to an elongated terminal of an electrical device comprising the steps of; selecting an electrical connector link containing first and second mutually transverse tubing sections, said first tubing section being open-ended and said second tubing section being integral with said first tubing section and extending transversely therefrom, the end of said first tubing section remote from said second tubing section being open, sliding the second tubing section onto and co-axial with the elongated terminal of the electrical device, inserting a wire to be electrically connected to the terminal into the open end of said first tubing section, and bonding said wire within said first tubing section and said second tubing section to said elongated terminal.

2. A method of connecting a wire as claimed in claim 1 wherein the step of bonding includes soldering said wire to said first tubing section and said second tubing section to said elongated terminal.

3. A method of connecting a wire as claimed in claim 1 wherein the step of bonding includes brazing said wire to said first tubing section and said second tubing section to said elongated terminal.

4. A method of connecting a wire as claimed in claim 1 wherein the end of said first tubing section remote from the second tubing section is a hollow straight length of tubing for the insertion therein of said wire.

5. A method of connecting a wire as claimed in claim 4 wherein said second tubing section constitutes a flattened length of the tubing shaped to fit snugly onto and around said elongated terminal.

6. A method as claimed in claim 1 wherein said electrical device is contained within an enclosure having an external wall wherein said elongated terminal extends radially a first distance from said wall and wherein said first tubing section and said wire extend perpendicularly to the elongated terminal and in a direction parallel to a portion of said wall within said first distance from said wall.

7. A method as claimed in claim 6 wherein said electrical device is a relay.

8. A method of connecting a wire to an elongated terminal of an electrical device comprising the steps of:

forming an electrical connector link out of a single continuous piece of tubing having first and second portions which are mutually transverse to each other; the first portion having a hollow straight length shaped for the insertion therein of said wire and said second portion constituting a flattened length of the tubing shaped to fit onto and around said elongated terminal;

sliding said shaped second portion onto said elongated terminal; and bonding said wire to said first portion hollow straight length and said second portion to said elongated terminal.

9. A method as claimed in claim 8, wherein the step of bonding said wire to said first portion hollow straight length and said second portion to said elongated terminal includes soldering said wire to said first portion and said second portion to said elongated terminal.

10. A method as claimed in claim 8, wherein the step of bonding said wire to said first portion hollow straight length and said second portion to said elongated terminal includes brazing said wire to said first portion and said second portion to said elongated terminal.

11. A method as claimed in claim 8 wherein said electrical device is contained within an enclosure having an external wall wherein said elongated terminal extends radially a first distance from said wall, and wherein said first tubing section and said wire extend perpendicularly to the elongated terminal and in a direction parallel to a portion of said wall within said first distance from said wall.

12. A method as claimed in claim 11 wherein said electrical device is a relay.

* * * * *